US006224403B1

(12) United States Patent
Okabe

(10) Patent No.: US 6,224,403 B1
(45) Date of Patent: May 1, 2001

(54) LEVER-FITTING TYPE CONNECTOR

(75) Inventor: Toshiaki Okabe, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/290,200

(22) Filed: Apr. 13, 1999

(30) Foreign Application Priority Data

Apr. 14, 1998 (JP) ..... 10-102984

(51) Int. Cl.[7] ..... H01R 13/62
(52) U.S. Cl. ..... 439/157; 439/160
(58) Field of Search ..... 439/157, 160, 439/341, 310, 372

(56) References Cited

U.S. PATENT DOCUMENTS

| | | | | |
|---|---|---|---|---|
| 5,362,245 | | 11/1994 | Suguro et al. | 439/160 |
| 5,431,573 | | 7/1995 | Endo et al. | 439/157 |
| 5,476,390 | * | 12/1995 | Taguchi et al. | 439/157 |
| 5,551,885 | * | 9/1996 | Yamanashi et al. | 439/157 |
| 5,711,682 | | 1/1998 | Maejima | 439/157 |
| 5,938,458 | * | 8/1999 | Krehbiel et al. | 439/157 |
| 5,964,604 | * | 10/1999 | Kashiyama et al. | 439/157 |
| 5,980,283 | * | 11/1999 | Okabe | 439/157 |

FOREIGN PATENT DOCUMENTS

| | | |
|---|---|---|
| 43 34 929 | 6/1995 | (DE) . |
| 43 36 711 | 8/1995 | (DE) . |
| 654 862 | 5/1995 | (EP) . |

* cited by examiner

*Primary Examiner*—Lincoln Donovan
*Assistant Examiner*—Kyung S. Lee
(74) *Attorney, Agent, or Firm*—Sughrue, Mion, Zinn, Macpeak & Seas, PLLC

(57) ABSTRACT

A lever-fitting type connector includes the connector (11) which is adapted to be fitted in the mating connector, and has bosses (15) formed thereon, and the lever (12) having rotation holes (25) in which the bosses (15) are inserted, respectively. The lever is pivotally moved about the bosses (15) so as to fit the connector (11) into the mating connector. Slots (18) are formed in the connector (11), and extend in a direction of fitting of the connector (11) into the mating connector. The lever (12) has projected portions (21) which are engaged respectively in the slots (18), and serve as pivot fulcrums when inserting the bosses respectively into the rotation holes (25). The lever has slanting guide surfaces (26) for guiding the bosses (15) respectively to the rotation holes (25). The bosses (15), the rotation holes (25) and the slanting guide surfaces (26) are disposed in a path of pivotal movement of the lever about the pivot fulcrums defined respectively by the projected portions (21).

3 Claims, 5 Drawing Sheets

LEVER-FITTING TYPE CONNECTOR

BACKGROUND OF THE INVENTION

1. Field of the Invention

The present invention relates to a lever-fitting type connector in which a connector is fitted into a mating connector by pivotally moving a lever.

The present application is based on Japanese Patent Application No. Hei. 10-102984, which is incorporated herein by reference.

2. Description of the Related Art

FIG. 6 shows a lever-fitting type connector, in which a lever 2 is pivotally mounted on a connector 1. The connector 1 includes a connector housing 3 for receiving terminals, and bosses 4 are formed respectively on opposite (right and left) side walls 3*a* of the connector housing 3. The lever 2 includes an operating portion 5, and lever walls 6 extending respectively from opposite ends of the operating portion 5. Rotation holes 7 are formed respectively through the lever walls 6, and the bosses 4 on the connector 1 are inserted respectively into the rotation holes 7, so that the lever 2 is pivotally supported on the connector 1. A cam groove 8 is formed in each lever wall 6, and pins, formed on a mating connector (not shown), are brought into engagement in these cam grooves 8, respectively, and in this condition, when the lever 2 is pivotally moved, the mating connector is moved relative to the connector 1, so that the two connectors are fitted together.

For mounting the lever 2 on the connector 1, the lever walls 6 are spread out by the fingers 6, as shown in FIG. 7, and in this condition the rotation holes 7 are aligned respectively with the bosses 4, with the connector housing 3 disposed between the lever walls 6, and the bosses 4 are inserted respectively into the rotation holes 7, thereby mounting the lever 2 on the connector 1. In this assembled condition, the bosses 4 pass respectively through the rotation holes 7, as shown in FIG. 8.

In the above-described construction, however, it is necessary to spread out the lever walls 6 when mounting the lever 2 on the connector 1, and this operation is cumbersome, and requires a relatively large force. And besides, if the lever is excessively spread, the lever 2 can be broken, and therefore this operation must be carried out while controlling the force.

SUMMARY OF THE INVENTION

It is therefore an object of the present invention to provide a lever-fitting type connector in which a lever can be easily mounted on a connector with a small force without the need for spreading the lever.

To achieve the above object, according to the first aspect of the present invention, there is provided a lever-fitting type connector which comprises a connector fittable to a mating connector, the connector having bosses formed thereon and slots extending in a fitting direction of the connector to the mating connector, a lever having rotation holes into which the bosses are respectively inserted, the lever being pivotally moved about the bosses so as to fit the connector into the mating connector, projected portions formed on the lever, the projected portions serving as pivot fulcrums while engaging respectively with the slots when the bosses are respectively inserted into the rotation holes, and slanting guide surfaces formed on the lever, the slanting guide surfaces respectively guiding the bosses to the rotation holes when the bosses are about to be respectively inserted into the rotation holes, wherein the bosses, the rotation holes and the slanting guide surfaces are disposed along a path of pivotal movement of the lever about the pivot fulcrums respectively defined by the projected portions. Therefore, during the pivotal movement of the lever, the bosses of the connector are brought into sliding contact respectively with the slanting guide surfaces disposed in the pivotal movement path, so that the lever is automatically spread, and then the rotation holes, disposed in the pivotal movement path, reach the bosses, respectively.

With this construction, by pivotally moving the lever about the pivot fulcrums, the lever can be mounted on the connector, and therefore this mounting operation can be effected easily with a small force without much spreading the lever. And besides, since the lever is not much spread, the lever will not be broken.

According to the second aspect of the present invention depending from the first aspect, preferably, the lever includes a pair of lever walls pivotally supported respectively on opposite side walls of the connector, and an operating portion interconnecting proximal end portions of the lever walls, and wherein the slanting guide surfaces are respectively formed at end portions of inner surfaces of the lever walls facing the connector. In this construction, the pair of lever walls are interconnected by the operating portion, and by pressing the operating portion, the pair of lever walls can be pivotally mounted on the connector at the same time. At this time, the lever walls are spread out simultaneously when the operating portion is pressed, since the slanting guide surfaces are formed respectively at the end portions of the lever walls. Therefore, the mounting operation can be effected rapidly.

According to the third aspect of the present invention depending from the second aspect, preferably, the end portions of the lever walls, on which the slanting guide surfaces are respectively formed, respectively taper in respective extending directions of the lever walls. In this construction, the slanting guide surface is slanting toward the inner side of the lever wall away from the outer side of the lever wall, and therefore the bosses, sliding respectively over the slanting guide surfaces, spread out the lever walls. Therefore, the bosses can be smoothly inserted into the rotation holes, respectively.

DETAILED DESCRIPTION OF THE PREFERRED EMBODIMENT

Figure 1:
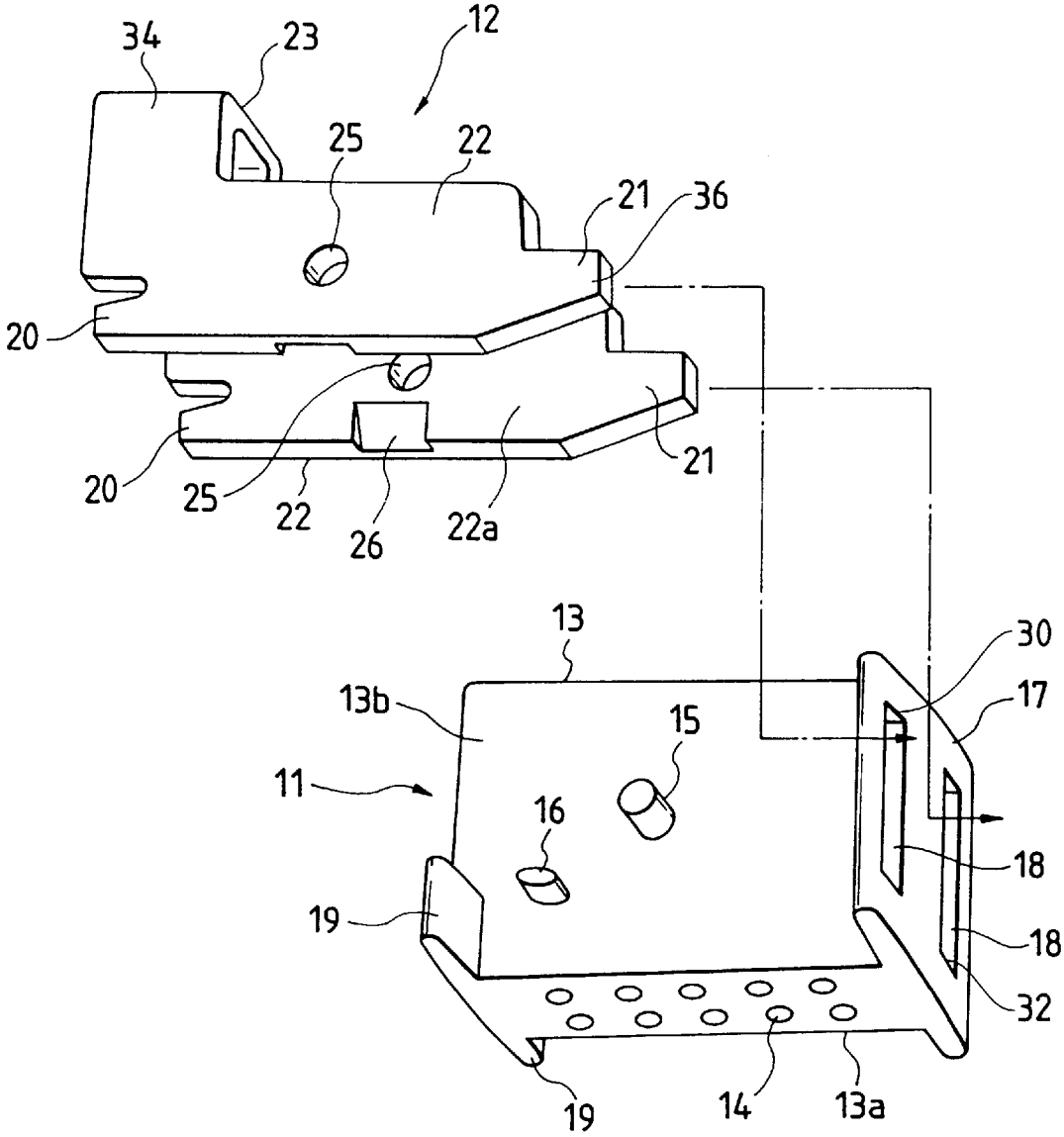
FIG. 1 is an exploded, perspective view of one preferred embodiment of a lever-fitting type connector of the present invention.

FIGS. 1 to 5 show one preferred embodiment of a lever-fitting type connector of the present invention. As shown in FIG. 1, this lever-fitting type connector 1 comprises a connector 11, and a lever 12 mounted on the connector 11.

The connector 11 includes a connector body 13 having a plurality of terminal insertion holes 14 formed in a bottom wall 13*a* thereof. A plurality of terminal receiving chambers (not shown) for respectively receiving terminals are formed within the connector body 13, and these terminal receiving chambers communicate with the terminal insertion holes 14, respectively. When the connector body 13 of this connector 11 is fitted into a mating connector (not shown), mating terminals in the mating connector are electrically connected respectively to the terminals in the connector body 13.

A boss 15 of a cylindrical shape and a retaining projection 16 are formed on each of opposite side walls 13*b* of the connector body 13. The bosses 15 pivotally support the lever 12 as described later. Retaining piece portions 20 (described later) of the lever 12 can be engaged with the retaining projections 16, respectively, thereby preventing the unnecessary pivotal movement of the lever 12.

A rib 17 is formed on one end wall of the connector body 13. The rib 17 extends outwardly from the opposite side walls 13*b* of the connector body 13, and a pair of slots 18 (having a proximal end wall 30 and a distal end wall 32) are formed respectively through extension portions of the rib 17 extending respectively from the opposite side walls 13*b*. The slots 18 extend in a direction of fitting of the connector 11 into the mating connector, and projected portions 21 (described later) of the lever 12 are engaged respectively in these slots 18. The rib 17 can be inserted into grooves, formed in a hood portion of the mating connector (not shown), so as to guide the insertion of the connector body into the hood portion.

Engagement piece portions 19 are formed on that end wall of the connector body 13 remote from the rib 17, and project outwardly. The engagement piece portions 19 can be engaged in engagement grooves, formed in the mating connector, so as to retain the connector 11 in the fitted condition.

The lever 12 includes a pair of right and left lever walls 22, and an operating portion 23 (located at a proximal end 34 of the lever) interconnecting the lever walls 22. The pair of lever walls 22 are pivotally moved in opposed relation to the opposite side walls 13*b* of the connector body 13, respectively, and the projected portion 21 is formed at a distal end 36 of each lever wall 22. The projected portions 21 are inserted and engaged respectively in the slots 18 in the connector body 13, and abut against the proximal end walls 30 of the slot which serve as fulcrums 24 for pivotal movement as described later.

The operating portion 23 interconnects those end portions of the lever walls 22 remote from the projected portions 21. The retaining piece portions 20 each for retaining engagement with the associated retaining projection 16 of the connector body 13 are formed respectively at those end portions of the lever walls 22 interconnected by the operating portion 23.

A rotation hole 25 and a slanting guide surface 26 are formed at each of the two lever walls 22. The bosses 15 on the connector body 13 are inserted respectively into the rotation holes 25, and as a result of this insertion, the lever 12 is pivotally supported on the connector 11.

The slanting guide surfaces 26 are formed respectively in opposed surfaces (inner surfaces) 22*a* of the two lever walls 22. Each slanting guide surface 26 extends from a lower edge of the lever wall 22 to a portion of the lever wall 22 disposed intermediate the upper and lower edges of the lever wall 22, and is slanting toward the inner side of the lever wall 22 away from the outer side of the lever wall 22. Each slanting guide surface 26 serves to guide the associated boss 15 of the connector body 13 to the rotation hole 25, and the boss 15 can slide over the slanting guide surface 26. The boss 15 slides over the slanting guide surface 26 from a lower end thereof toward an upper end thereof, and when the bosses 15 thus slide over the slanting guide surfaces 26, respectively, the lever walls 22 are spread out.

Figure 3:
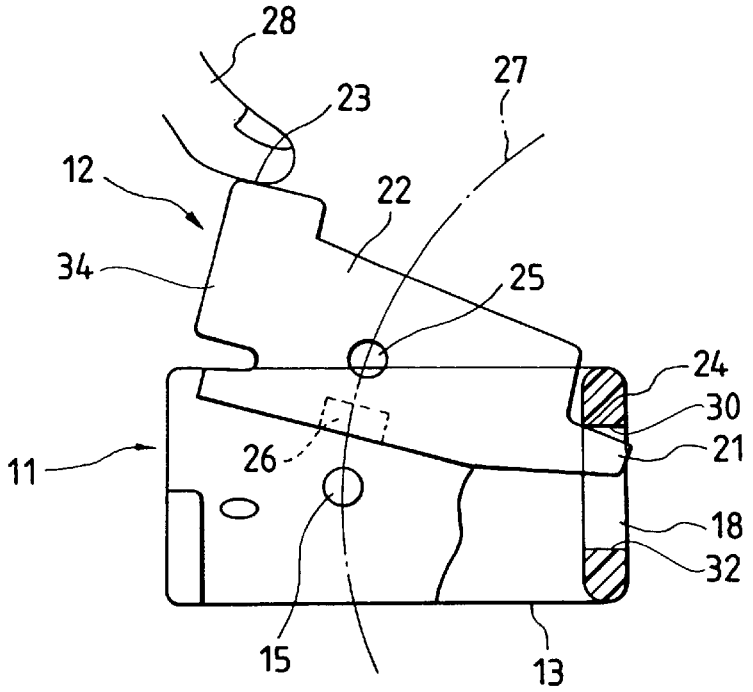
FIG. 3 is a side-elevational view showing a condition in which a lever is pivotally moved.

As shown in FIG. 3, the slanting surfaces 26 and the rotation holes 25, formed at the lever 12, and the bosses 15 on the connector body 13 are disposed in a path 27 of pivotal movement of the lever 12 about the pivot fulcrums 24 defined respectively by the projected portions 21 engaged respectively in the slots 18 in the connector body 13. With this arrangement, the slanting guide surfaces 26 can smoothly guide the bosses 15 to the rotation holes 25, respectively.

Figure 2:
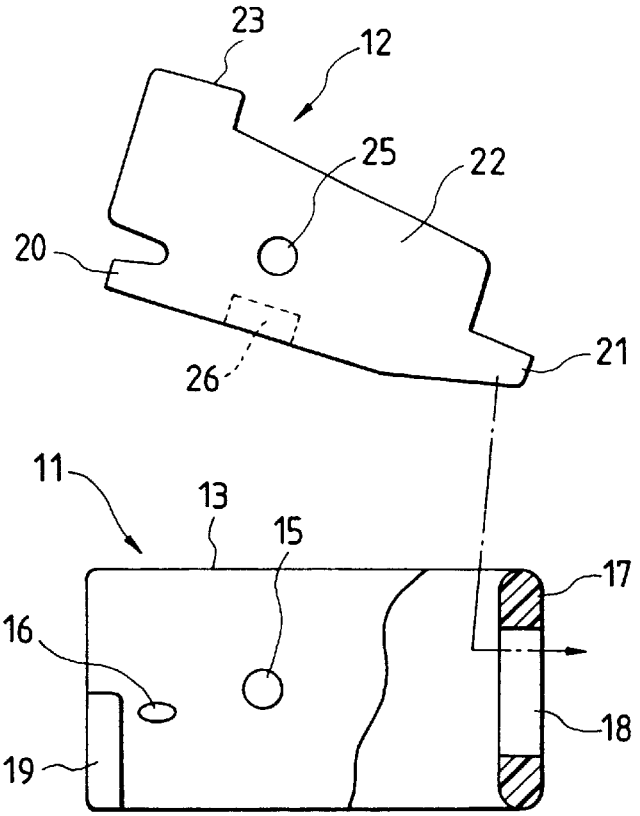
FIG. 2 is a side-elevational view showing an initial stage of a lever-mounting operation.

Next, an assembling operation, in which the lever 12 is mounted on the connector 11 in this embodiment, will be described. First, the lever 12 is moved downward toward the connector body 13 as shown in FIG. 2, and the projected portions 21 of the lever 12 are engaged respectively in the slots 18. As a result of this engagement, the lever 12 is provisionally mounted on the connector 11. Then, the operating portion 23 is pressed by the finger 28 or other means, thereby moving the lever 12 in a direction of mounting of the lever on the connector body 13, as shown in FIG. 3. At this time, those portions of the projected portions 21, engaged respectively in the slots 18, serve as the pivot fulcrums 24, and therefore the lever 12 is pivotally moved about the pivot fulcrums 24 along the pivotal movement path 27. During this pivotal movement, the pivot fulcrums 24 serve as the fulcrum, and the operating portion 23 serves as a force-applying portion, and therefore the lever can be easily pivotally moved even with a small force.

Figure 4:
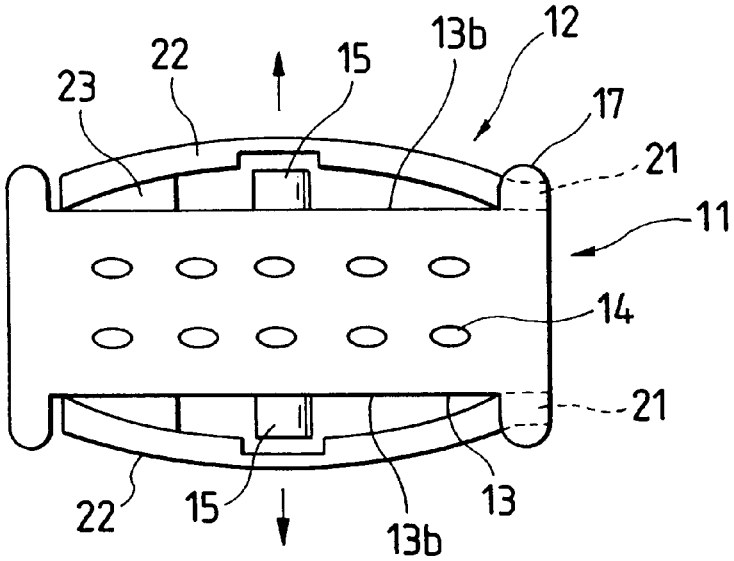
FIG. 4 is a bottom view showing a condition in which the lever is pivotally moved.
Figure 5:
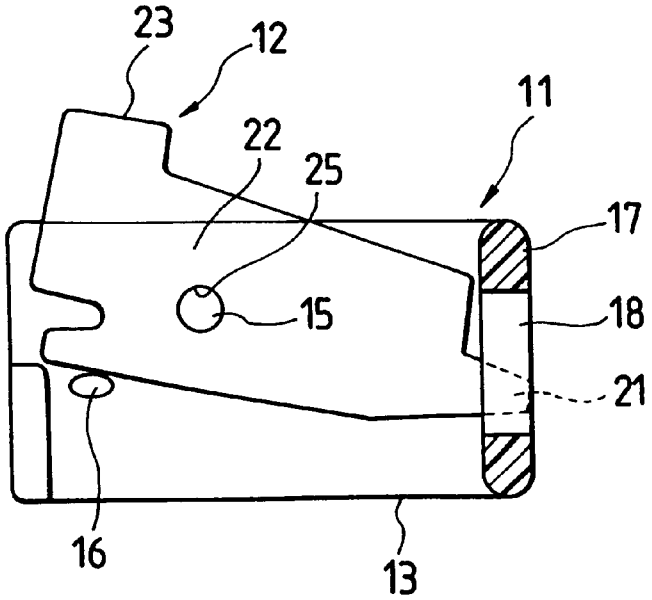
FIG. 5 is a side-elevational view showing a condition in which the lever is mounted.
Figure 6:
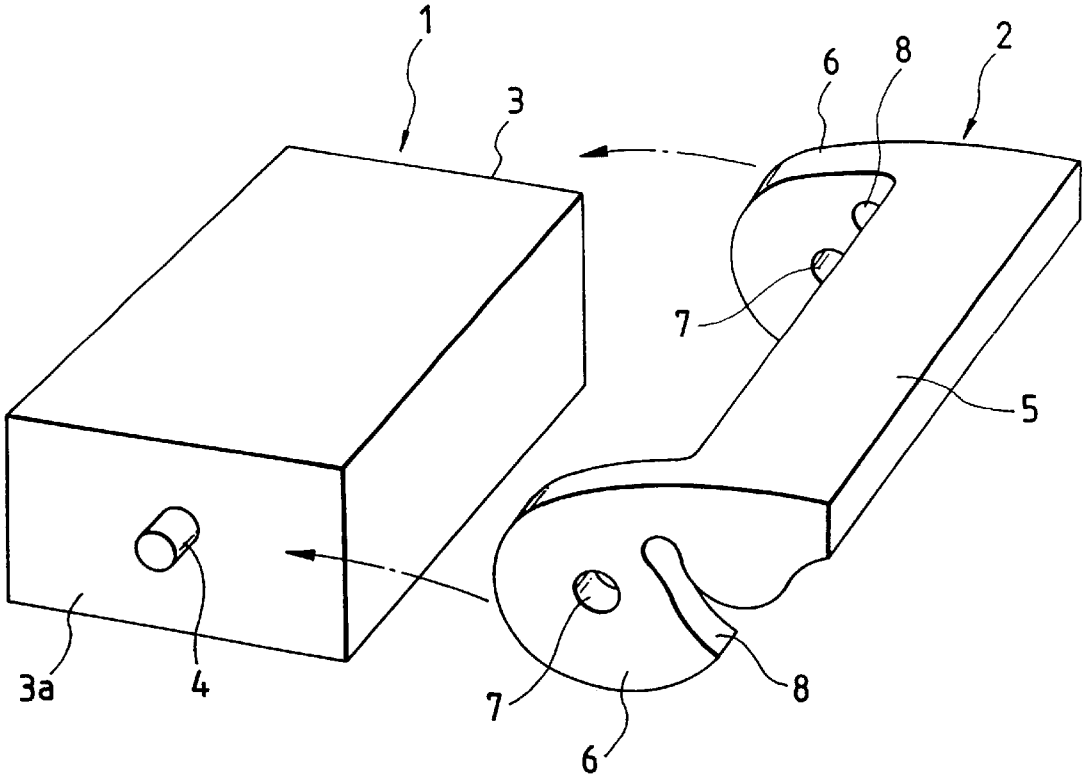
FIG. 6 PRIOR ART
FIG. 6 is an exploded, perspective view of the related lever-fitting type connector.
Figure 7:
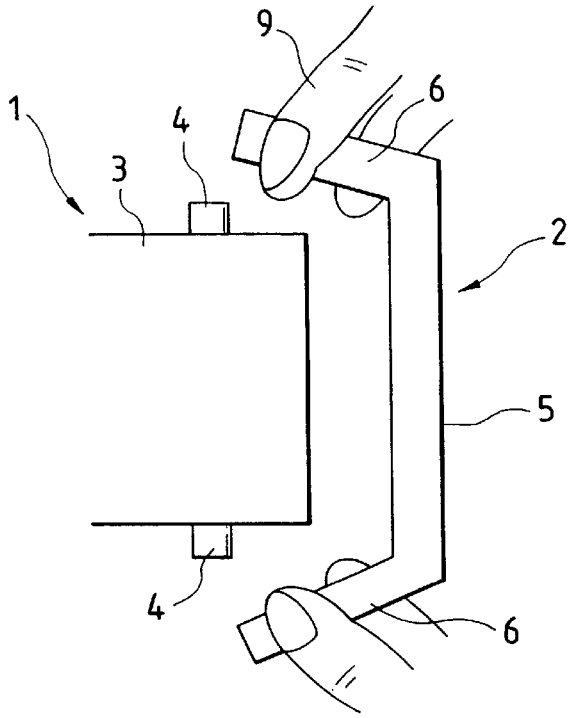
FIG. 7 PRIOR ART
FIG. 7 is a plan view showing the related assembling procedure.
Figure 8:
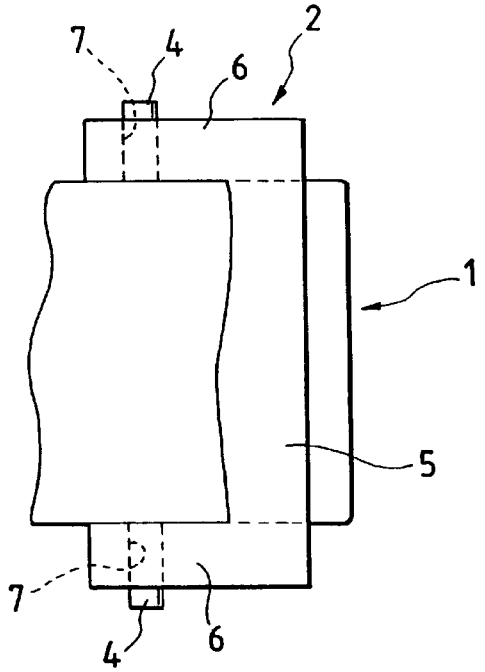
FIG. 8 PRIOR ART
FIG. 8 is a plan view showing the related lever-fitting type connector in its assembled condition.

The slanting guide surfaces 26, the rotation holes 25 and the bosses 15 are disposed in the pivotal movement path 27, and each boss 15 first slides along the associated slanting guide surface 26 upwardly from the lower end of this surface 26. The slanting guide surface 26 is slanting toward the inner side of the lever wall 22 away from the outer side of the lever wall 22, and therefore when the bosses 15 slide, the lever walls 22 are spread outwardly respectively beyond the bosses 15, as shown in FIG. 4. In this condition, when the lever 12 is further pivotally moved, the bosses 15 reach the rotation holes 25, respectively. Therefore, the bosses 15 can be smoothly inserted respectively into the rotation holes 25, and the lever 12 is mounted on the connector 11 as shown in FIG. 5.

In this embodiment, the bosses 15 of the connector 11, the rotation holes 25, formed in the lever 12 for respectively receiving the bosses 15, and the slanting guide surfaces 26, formed on the lever 12 for guiding the bosses 15 respectively to the rotation holes 25, are disposed in the path 27 of pivotal movement of the lever 12 about the pivot fulcrums 24 defined respectively by the projected portions 21 of the lever 12 engaged respectively in the slots 18 in the connector 11. Therefore, when the lever 12 is pivotally moved, the bosses 15 slide respectively over the slanting guide surfaces 26 to spread the lever 12, and can be positively inserted respectively into the rotation holes 25. Therefore, the lever 12 can be easily mounted on the connector 11 without much spreading the lever 12. Since the lever 12 is not excessively spread, the lever 12 will not be broken. And besides, the pivot fulcrums 24 serve as the fulcrum while the operating portion

23 remote from the pivot fulcrums 24 serves as the force-applying point, and therefore the lever can be easily pivotally moved even with a small force because of leverage, and the efficiency of the operation is enhanced.

Each slanting guide surface 26 is formed at the lower end portion of the lever wall 22, and therefore the lever walls 22 are spread out simultaneously when the operating portion 23 is pressed. Therefore, the assembling operation can be effected rapidly. And besides, each slanting guide surface 26 is slanting toward the inner side of the lever wall 22 away from the outer side of the lever wall 22, and therefore the bosses 15, when sliding respectively over the slanting guide surfaces 26, can positively spread out the lever walls 22.

As described above, in the present invention, by pivotally moving the lever about the pivot fulcrums, the lever can be easily mounted on the connector. Therefore, this operation can be easily effected with a small force without much spreading the lever, and the lever will not be broken.

In the second aspect of the present invention, the slanting guide surfaces are formed respectively at the end portions of the lever walls, and therefore when the operating portion is pressed, the lever walls are simultaneously spread out, and the mounting operation can be effected rapidly.

In the third aspect of the present invention, each of the slanting guide surfaces is slanting toward the inner side of the associated lever wall away from the outer side of the lever wall. Therefore, the lever walls can be positively spread out by the sliding movement of the bosses, and the bosses can be smoothly inserted into the rotation holes, respectively.

What is claimed is:

1. A lever-fitting type connector, comprising:

a connector fittable to a mating connector, the connector having bosses formed thereon and slots extending in a fitting direction of the connector to the mating connector, said slots having a proximal end wall and a distal end wall;

a lever having a proximal end and a distal end and having rotation holes into which the bosses are respectively inserted when a force is applied to the proximal end of said lever, the lever being pivotally moved about the bosses so as to fit the connector into the mating connector;

projected portions formed on the distal end of said lever, the projected portions serving as pivot fulcrums while abutting against the proximal end wall of said slots when the bosses are respectively inserted into the rotation holes; and slanting guide surfaces formed on the lever, the slanting guide surfaces respectively guiding the bosses to the rotation holes when the bosses are about to be respectively inserted into the rotation holes, wherein the bosses, the rotation holes and the slanting guide surfaces are disposed along a path of pivotal movement of the lever about the pivot fulcrums respectively defined by the projected portions.

2. The lever-fitting type connector of claim 1, wherein the lever includes a pair of lever walls pivotally supported respectively on opposite side walls of the connector, and an operating portion interconnecting the lever walls at said proximal end, and wherein the slanting guide surfaces are respectively formed at bottom portions of inner surfaces of the lever walls facing the connector.

3. The lever-fitting type connector of claim 2, wherein the bottom portions of the lever walls, on which the slanting guide surfaces are respectively formed, respectively taper in respective extending directions of the lever walls.

* * * * *